US011723416B2

(12) United States Patent
Strottner et al.

(10) Patent No.: US 11,723,416 B2
(45) Date of Patent: Aug. 15, 2023

(54) BODY SUIT

(71) Applicant: J&C Brand, LLC, Midvale, UT (US)

(72) Inventors: Jennifer Strottner, Midvale, UT (US); Callie Childs, Broomfield, CO (US)

(73) Assignee: J&C Brand, LLC, Midvale, UT (US)

( * ) Notice: Subject to any disclaimer, the term of this patent is extended or adjusted under 35 U.S.C. 154(b) by 15 days.

(21) Appl. No.: 17/387,470

(22) Filed: Jul. 28, 2021

(65) Prior Publication Data

US 2022/0015462 A1 Jan. 20, 2022

Related U.S. Application Data

(63) Continuation of application No. 16/579,063, filed on Sep. 23, 2019, now Pat. No. 11,071,330.

(60) Provisional application No. 62/735,163, filed on Sep. 23, 2018.

(51) Int. Cl.
*A41C 1/10* (2006.01)
*A41D 1/21* (2018.01)

(52) U.S. Cl.
CPC . *A41C 1/10* (2013.01); *A41D 1/21* (2018.01)

(58) Field of Classification Search
CPC ..... A41D 1/21
USPC ..... 450/155
See application file for complete search history.

(56) References Cited

U.S. PATENT DOCUMENTS

| | | | | |
|---|---|---|---|---|
| 2,166,312 | A | 7/1939 | Lunney | |
| 2,575,605 | A | 11/1951 | Vandercook | |
| 4,789,372 | A | 12/1988 | Wicks | |
| 4,822,317 | A | 4/1989 | Wimmer | |
| 4,952,192 | A | 8/1990 | Burke | |
| 5,828,059 | A | 10/1998 | Udd | |
| 5,928,059 | A | 7/1999 | Wicks | |
| 8,113,911 | B1 * | 2/2012 | Hansen | A41D 1/21 450/86 |
| 11,071,330 | B2 * | 7/2021 | Strottner | A41D 1/22 |
| 2008/0254712 | A1 | 10/2008 | Christensen | |
| 2013/0253397 | A1 | 9/2013 | Samoodi | |

* cited by examiner

*Primary Examiner* — Gloria M Hale
(74) *Attorney, Agent, or Firm* — Dentons Durham Jones Pinegar

(57) ABSTRACT

A maternity garment, or bodysuit, configured to provide support and comfort to a pregnant woman. The garment may include an opening in the front of the garment exposing the stomach, or belly, of a woman. The garment may further include reinforced or compression material that passes underneath the belly providing support to the belly. Additionally, a reinforced back panel may be positioned on the back of the garment to provide additional support to the lower back of a pregnant woman. Straps may extend over the shoulders and cross in the back. Furthermore, a support strap may pass under the breasts as well. The garment may include a seamless one-piece fabric and may be a bikini or thong cut back depending on a woman's preference to provide both comfort and style.

24 Claims, 8 Drawing Sheets

BODY SUIT

CROSS REFERENCE TO RELATED APPLICATION

This application is a continuation of U.S. application Ser. No. 16/579,063 (the '063 Application"), filed Sep. 23, 2019, entitled BODY SUIT, now issued as U.S. Pat. No. 11,071,330, which claims the benefit of priority to the Sep. 23, 2018 filing date of U.S. Provisional Application No. 62/735,163, titled BODY SUIT ("the '163 Provisional Application". The entire disclosure of the '163 Provisional Application and '063 Application are hereby incorporated herein.

TECHNICAL FIELD

This disclosure relates generally to a bodysuit, or body suit, capable of providing support to an individual, more specifically, a woman, and more specifically a pregnant woman to help distribute weight of unborn child around the body of the woman to help in preventing pain or strain on the body of the woman. The bodysuit may include an opening in the front that may expose the stomach of a woman reinforced or compression material underneath the stomach and another reinforced or compression material in the back for support.

RELATED ART

Bodysuits have been utilized for decades. Bodysuits have also been around for decades and are known for providing support in different areas of an individual's body. Swimming suits, and particularly one-piece swimming suits, have been around for decades, if not centuries. More recently many different support mechanisms for pregnant women. Most often pregnancy support garments cover up the stomach of the woman and feels like the support garment is smashing or putting pressure on the stomach of the woman.

Many different methods are utilized to provide support for a pregnant stomach. One such example is to provide a compression garment that may be solely an abdominal or torso support with a top opening and a bottom opening that can be pulled up or down over the abdomen or stomach.

Alternatively, there are those garments that may resemble a bodysuit that has leg holes, a crotch area, a torso section and a bust, or breast, section with a chest support, or bra-like support. Straps may extend over the shoulder to aid in the support of the bust. The material is often composed of compression material that essentially compresses every portion of the body that fits within the garment.

Additionally, bodysuit and support garments may be many different styles and most often include a different bottom portion. For pregnancy support garments a bottom portion, or portion that covers the buttocks and groin area, may be a "boy-short" or "bikini" style that provides support for the buttocks portion as well and, perhaps in addition, to supporting the stomach as well. Fasteners, clips, snaps and other mechanisms for fastening bodysuits, bras, lingerie and the like are well known in the art and have been utilized in apparel and garments.

SUMMARY

This disclosure, in at least on aspect, relates to a garment, or bodysuit, that may provide support to the stomach, or belly, of a pregnant woman by removing weight or pressure from the pelvis and lower back area. The garment may be a maternity garment that provides optimum support to the belly of a woman while not compressing the belly region. The garment may allow for exposure of the belly. The garment may have a reinforced under belly support and may be a little stiffer than the other areas of the garment, or rather may simply be not as pliable as other particular areas of the garment while still being very malleable.

The garment may also expose the bust, or breasts, allowing a user to wear any bra of her choosing with the garment. The bodysuit, or garment, may include straps that run over each of the shoulders of the user. Each strap may provide equal support over each shoulder.

A back panel of the garment may include reinforced stitching, or webbing, in the back panel of the garment that helps focus weight and provide support in a different area than a single point when the garment is not being worn. The back panel support region may be diamond shaped pattern that distributes the support across a greater surface area of the back and greater support on the lower back. The shoulder straps may cross from the right shoulder to the left side of the back and the left shoulder may cross from the left shoulder to the right side of the back providing further support and weight distributing support to the back and under belly.

Additionally, the garment may include a fastening mechanism in the front groin, or front crotch. The fastener may allow a user to easily put on or remove the garment. The fastening mechanism may be a number of different systems such as snaps, buttons, Velcro®, clasps, or other type of closure mechanism for garments that are known in the art.

The garment may vary in size based on the user. Each of the various sizes is directly reflective on the size of the woman and may be the size of the belly as well.

DETAILED DESCRIPTION

The following description sets forth an embodiment of a garment, or maternity garment, and its ability to support the belly of a pregnant woman. The garment may include multiple reinforced portions that provide support for the users back and under belly.

Figure 1:
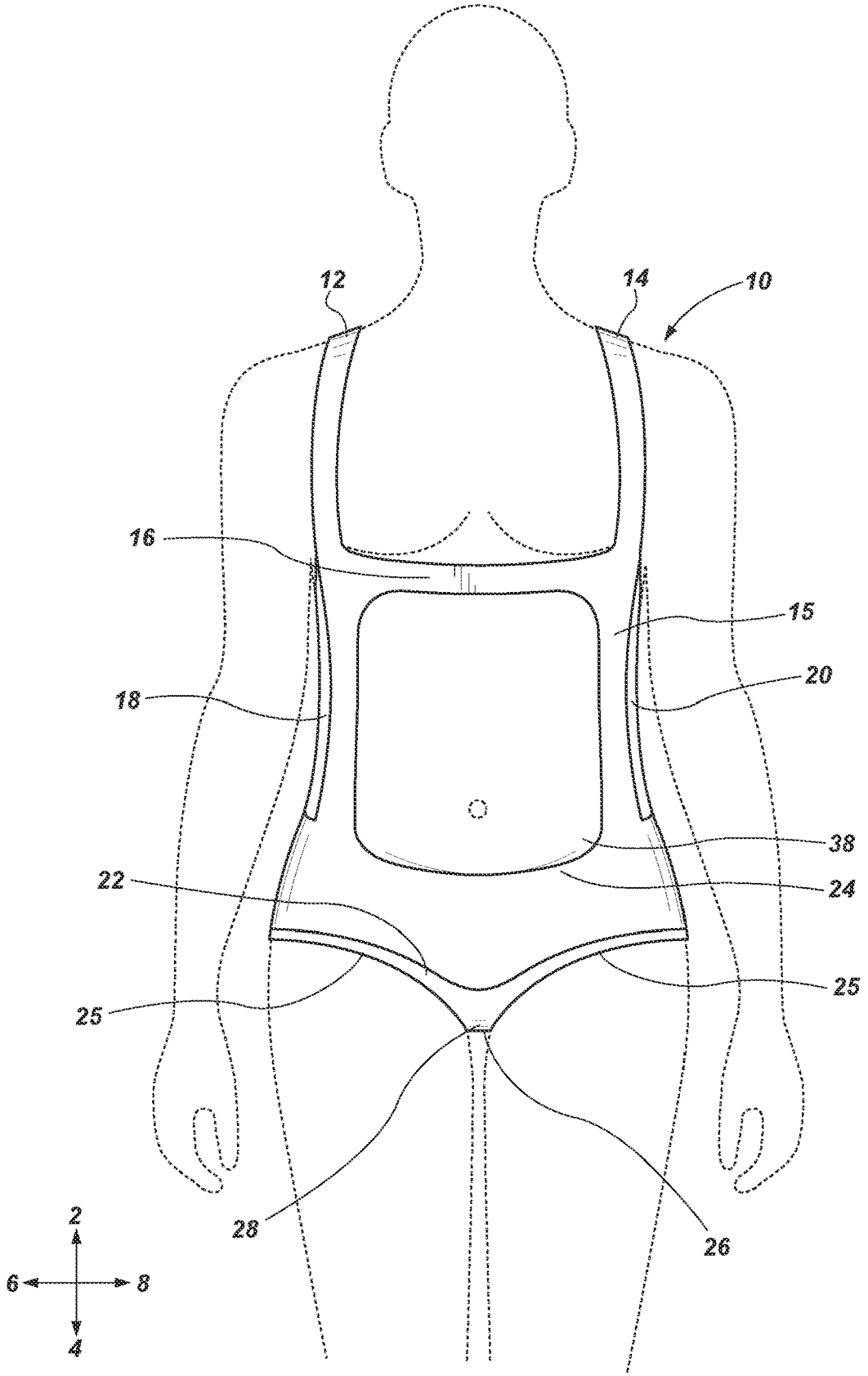
FIG. 1 is a front view of a garment with an open belly portion.
Figure 2:
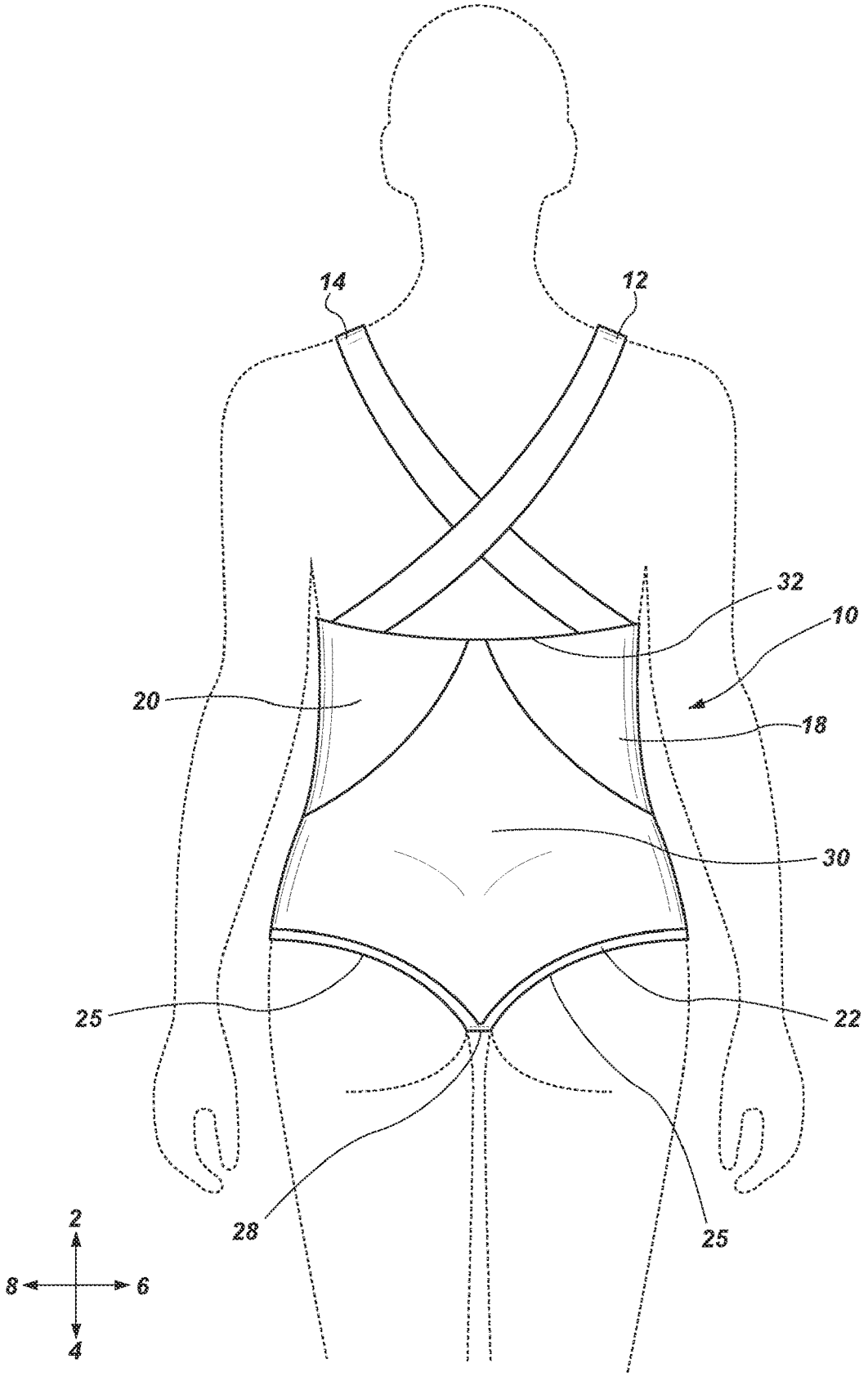
FIG. 2 is a back view of the garment of FIG. 1.
Figure 3:
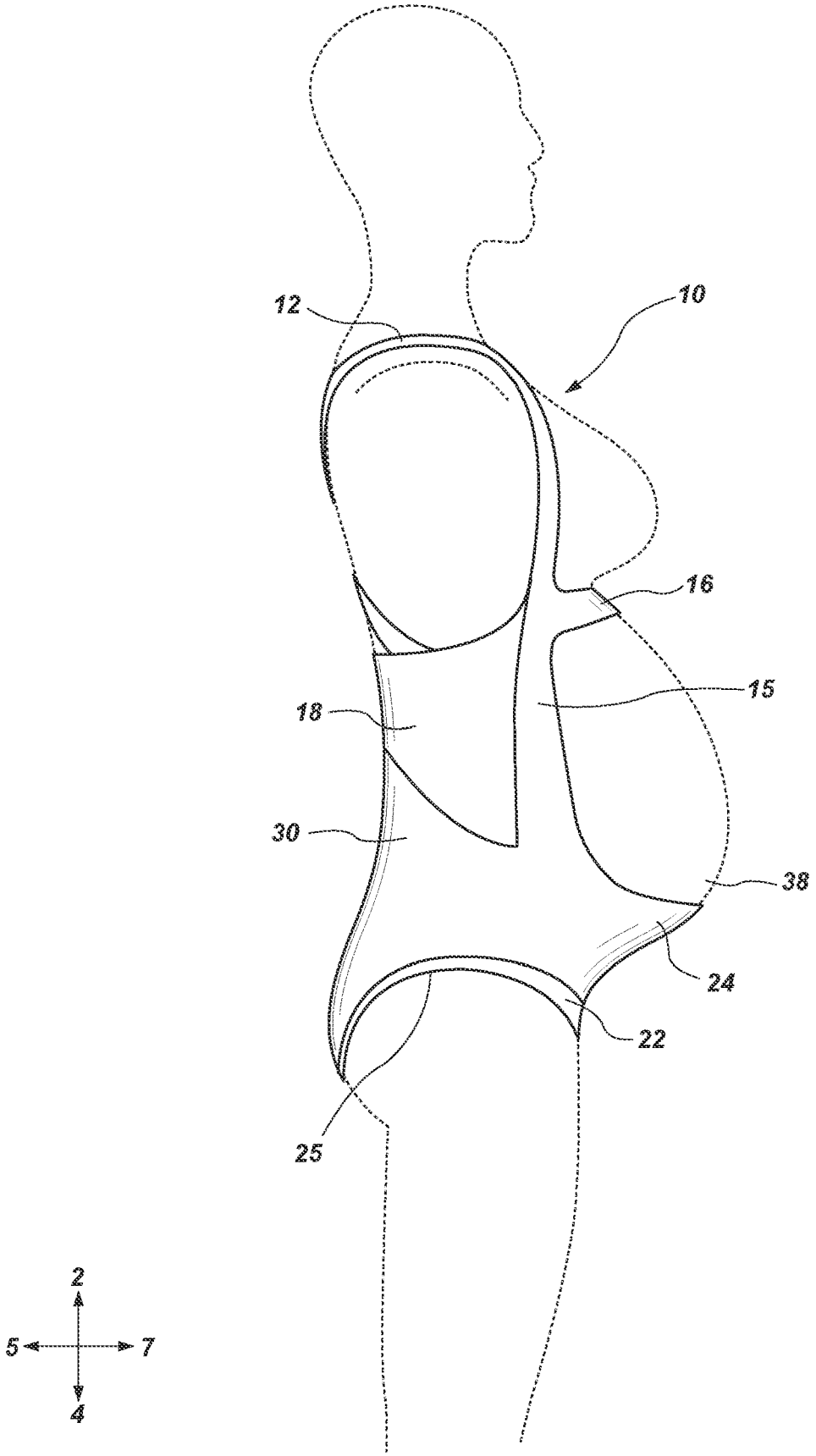
FIG. 3 is a side view of the garment of FIG. 1.

FIG. 1-FIG. 3 may be oriented according to the reference arrow diagram 1, having a superior direction 2 (toward a head), an inferior direction 4 (toward a foot), a right lateral direction 6 (toward a right side), a left lateral direction 8 (toward a left side), a posterior direction 5 (toward a back), and an anterior direction 7 (toward a front). In this application, "left" and "right" are used with reference to a posterior view and the right and left sides of a person. "Medial" refers to a position or orientation toward a sagittal plane (i.e., plane of symmetry that separates left and right sides of a woman), and "lateral" refers to a position or orientation relatively further from the sagittal plane.

It will be appreciated that although this disclosure refers to "panels" or "surfaces" that each of those panels or surfaces may be integrated and part of the other panel or surface and the entire system, or garment, or bodysuit, may be constructed out of a single piece of material with no seams or stops are starts (i.e. a single seamless piece of fabric). Alternatively, the system, or garment, or bodysuit, may be made up of multiple pieces of material secured together via sewing, welding, ultrasonic welding, laser welding, stamp heat welding, hot plate welding, gluing, taping, one piece woven, and other fabric joining techniques known by those having skill in the art.

FIG. 1 illustrates a garment 10 with features that provide support for a woman who may be pregnant. The garment 10 may resemble a bodysuit, or swimsuit. The garment 10 may include different levels of compression in different areas or regions of the garment 10. For example, an upper back portion may provide less compression than an underbelly portion. The garment 10 may include a pair of shoulder straps, a first, or right, shoulder strap 12 and a second, or left, shoulder strap 14 that extend over the shoulders of the woman. The first shoulder strap 12 may cross from the right shoulder to the left side of the back of the garment 10 and the second shoulder strap 14 may cross from the left shoulder to the right side of the back of the garment 10 providing further support and weight distributing support to the back and under belly. A front portion 15 may include a front side of the first shoulder strap 12 and second shoulder strap and a support band 16 which may extend under the breasts of a woman while wearing the garment 10. The support band 16 may extend from a right side to a left side of the front portion 15. A first, or right, side panel 18 may extend inferiorly from the right shoulder strap 12 down a right lateral side and around to the back, or the upper back. A second, or left, side panel 20 may extend inferiorly from the left shoulder strap 14 down a left lateral side and around to the back, or the upper back. The bust of the woman wearing the garment may be exposed allowing a woman to wear a bra of her choice. The shoulder straps 12, 14 and support band 16 may be comprised of a higher compression material than the first side panel 18 and second side panel 20.

A void 38, or open portion, may be positioned on the front portion 15 of the garment 10 and may extend from the support band 16 to the underbelly portion 26 and between. The void 38 may expose the belly of a pregnant woman so to provide greater comfort to the user.

The shoulder straps 12, 14 may extend superiorly from the right and left panels 18, 20 respectively and then extend inferiorly after passing over the shoulders of a woman and toward the opposing lateral side. The shoulder straps 12, 14 may be comprised of a softer material, while still maintaining higher compression, and may be wider to provide a comfortable feel without the shoulder straps 12, 14 digging into the woman's shoulders. However, the shoulder straps 12, 14 may also be relatively thin. It will be appreciated that the shoulder straps 12, 14 may vary in width and may be adjustable both in length and width by a user.

A bottom portion 22, or pelvic portion, or bikini portion, may resemble women's underwear in that the pelvic portion extends from a front of the woman, around the hips of the woman and passing through the groin to the buttock region. The pelvic portion 22 may include a less compression material that differs from the higher compression materials. An underbelly portion 24, or lower abdomen portion, may be positioned superior, or above, or immediately superior and anterior the pelvic portion. The underbelly portion 24 may be a higher compression fabric, similar to or the same as the support band 16 and shoulder straps 12, 14, or other reinforced fabric that may reside directly under the belly of a pregnant woman. The underbelly portion 24 may be a separate panel of fabric that is secured to the pelvic portion 22 or may be integrated to the pelvic portion 22 with additional fabric with a denser/stronger weave of material for the underbelly portion 24.

The pelvic portion 22 may include two openings 25, or holes, for legs to pass through the garment 10. The openings 25 may be mirror images of each other and are configured to fit the legs of a user, woman, or pregnant woman.

The garment 10 and particularly the underbelly portion 24 may provide a woman with extra support of the belly, or pregnant belly, by redistributing the load, or weight, bearing to the shoulders and different portions of the back. The compression material may further hold and pull the belly closer to the core of the woman's body providing less stress on muscles and joints and particularly less stress on the lower back of the woman.

The underbelly portion 24 may be one a one-piece material, or contiguous material, and may extend the entire circumference of the garment 10 extending from the anterior to the posterior, or front to the back. The underbelly portion 24 may be higher compression that extends around the entire body of a woman around each lateral side and the posterior side of a woman. The side panels 18, 20 may extend from the shoulder straps 12, 14 respectively along the lateral side to the underbelly portion 24.

The pelvic portion 22 may be a one piece material, or contiguous material, and may extend the entire circumference of the garment 10 extending from the anterior to the posterior, or front to the back, around the lateral sides as well as through the groin area. Alternatively, the pelvic portion 22 may include a fastening mechanism 26 in a groin area 28 of the garment 10 that may join the front of the pelvic portion 22 to the back of the pelvic portion 22. The fastening mechanism 26 may be a snap closure or other similar fastening mechanism commonly used in the apparel industry. The fastening mechanism 26 may provide ease in placing the garment 10 on or removing the garment 10 as well. The fastening mechanism 26 may also provide ease for other purposes as well. Alternatively, the groin area 28 may be one continuous piece of fabric, which may be the same piece of one-piece seamless fabric.

Referring to FIG. 2, a posterior view of the garment 10 is illustrated. A back panel 30 may extend inferiorly from a top edge 32 of a body of the garment 10 or from the shoulder straps 12, 14 to the pelvic portion 22. A portion of the first side panel 18 and second side panel 20 may extend at least partially around the back and toward an upper portion of the back of the garment 10. The first side panel 18 and second side panel 20 may taper toward the top edge of the body of the garment 10. The back panel 30 may extend from the first side panel 18 to the second side panel 20 and may be a single piece material, or contiguous material, from the top edge 32 to the pelvic portion 22. There may not be any clear delineation from the back panel 30 and the pelvic portion 22. The back panel 30 may be comprised of a higher compression material, similar to or the same as the underbelly portion 24.

The back panel 30 may extend between the shoulder straps 12, 14 and may begin at the top edge 32 of the garment and beneath the scapulae, or shoulder blades, of the woman wearing it. The shoulder straps 12, 14 and the back panel 30 may hide the straps of a bra that a woman wears.

The first shoulder 12 strap may cross from the left side of the back over the right shoulder to the right side of the front of the garment 10 and the second shoulder strap 14 may cross from the right side of the back over the left shoulder to the left side of the front of the garment 10 providing further support and weight distributing support to the back and under belly. The cross-back design may expose the scapulae and cross across the spine of the woman wearing the garment 10, preventing, or limiting, strap movement on the shoulders or preventing or limiting sliding of the shoulder straps 12, 14 off the shoulders.

As previously disclosed, the underbelly portion 24 may extend under the belly of a woman from the first and second side panels 18, 20; however, alternatively, the underbelly portion 24 may extend circumferentially and engage the back panel 30 with the same material or weave of material.

The pelvic portion 22 may integrate with the back panel 30 to include a backside panel 34 that may cover the buttocks of the woman wearing the garment 10. The backside panel 34 may be a bikini cut, or brief cut, or thong cut. The bikini cut may provide more coverage of the buttocks while the thong cut may expose much of the buttocks. While it is appreciated that these two variations or cuts of the backside panel 34 may be primarily used or manufactured it will also be appreciated that a boy-short or other alternative cut well known in the undergarment industry may be used or manufactured as well. A woman may also choose to wear her own underwear underneath the garment 10.

The garment 10, or bodysuit, may be made up of a blend of regular or recycled manmade fibers, including, but not limited to nylon, spandex, polyester, polymers, and elastomers. However, it will be appreciated that any materials and fabrics are contemplated that allow for stretch and support. In addition the garment 10 may provide stylish support and comfort to a woman.

Figure 4:
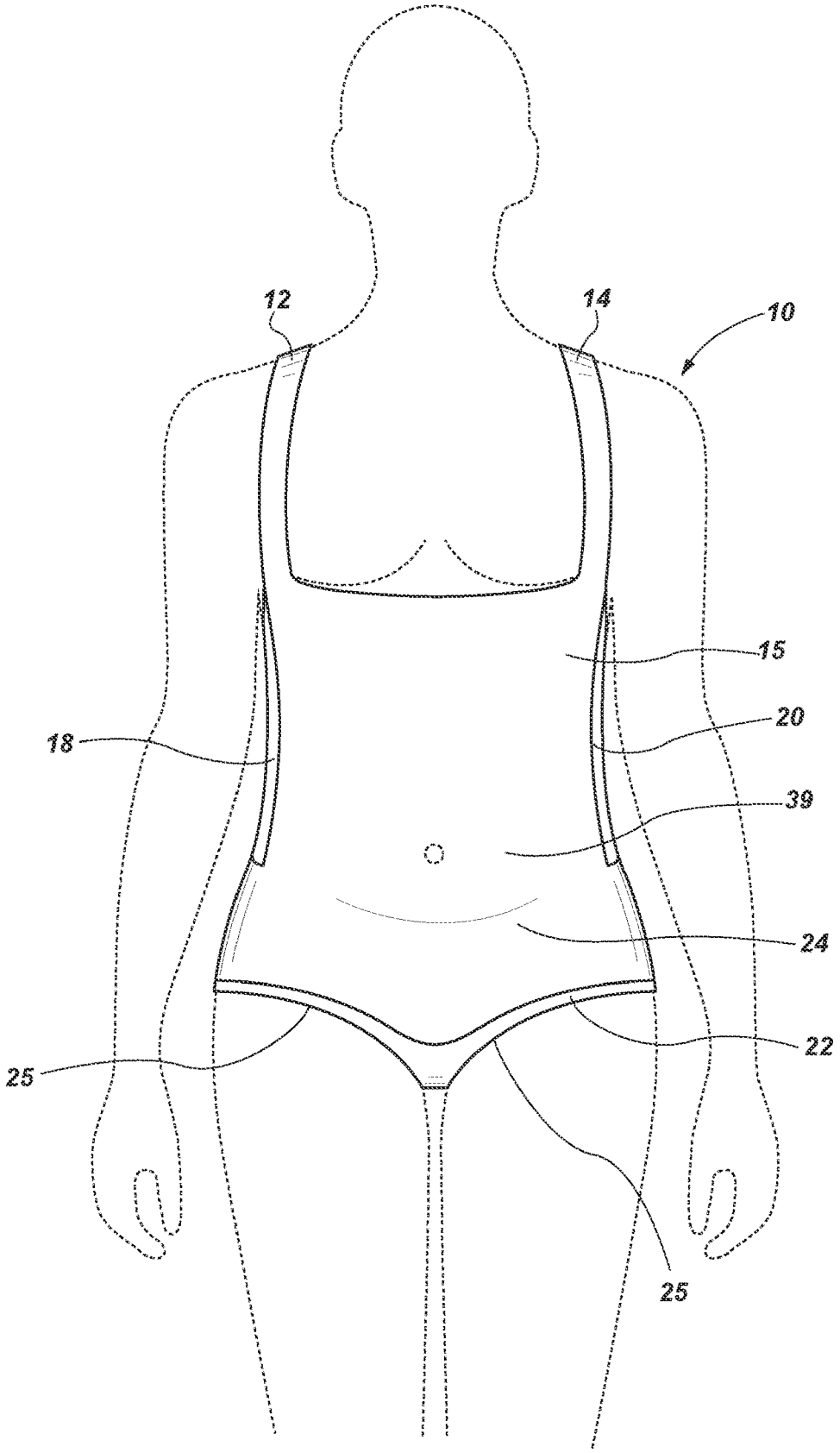
FIG. 4 is a front view of a garment with a closed belly portion.
Figure 5:
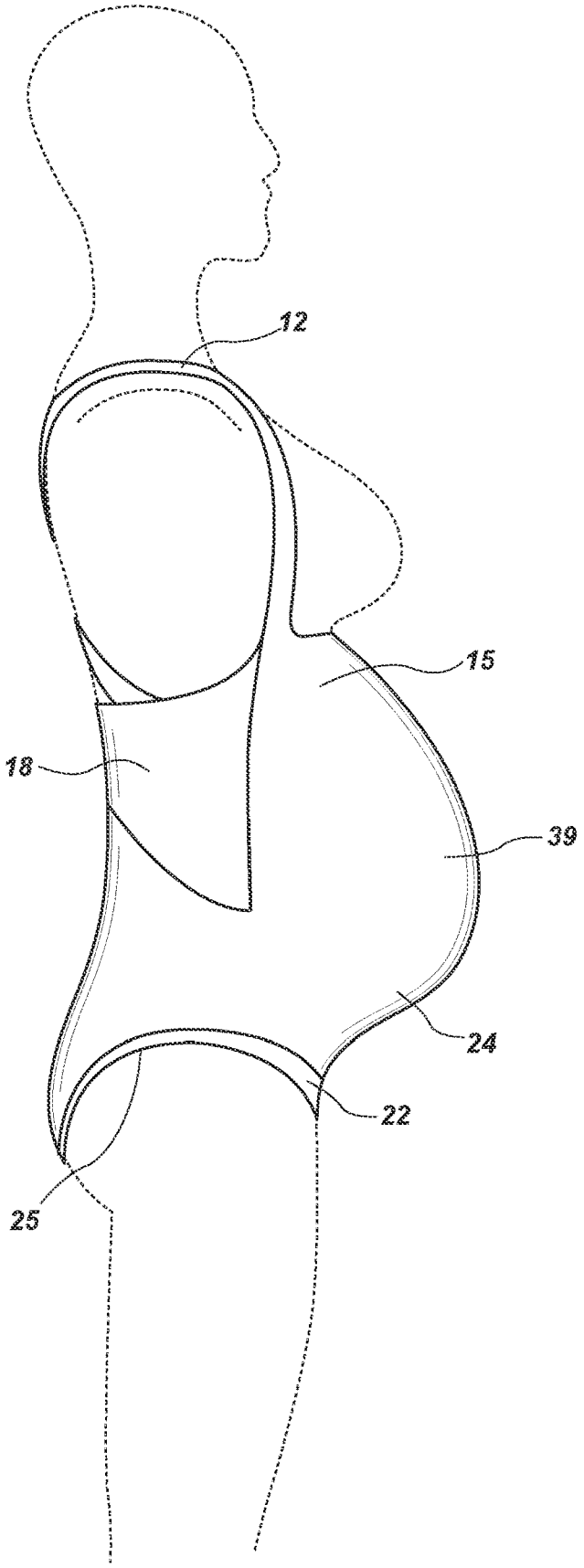
FIG. 5 is a side view of the garment of FIG. 4.

Regarding FIG. 4 and FIG. 5 an alternative embodiment of the garment 10 is depicted. It will be appreciated that the features may be similar or the same as previously described herein. As depicted, a lesser compression fabric may be utilized as a cover 39 over the void 38.

Figure 6:
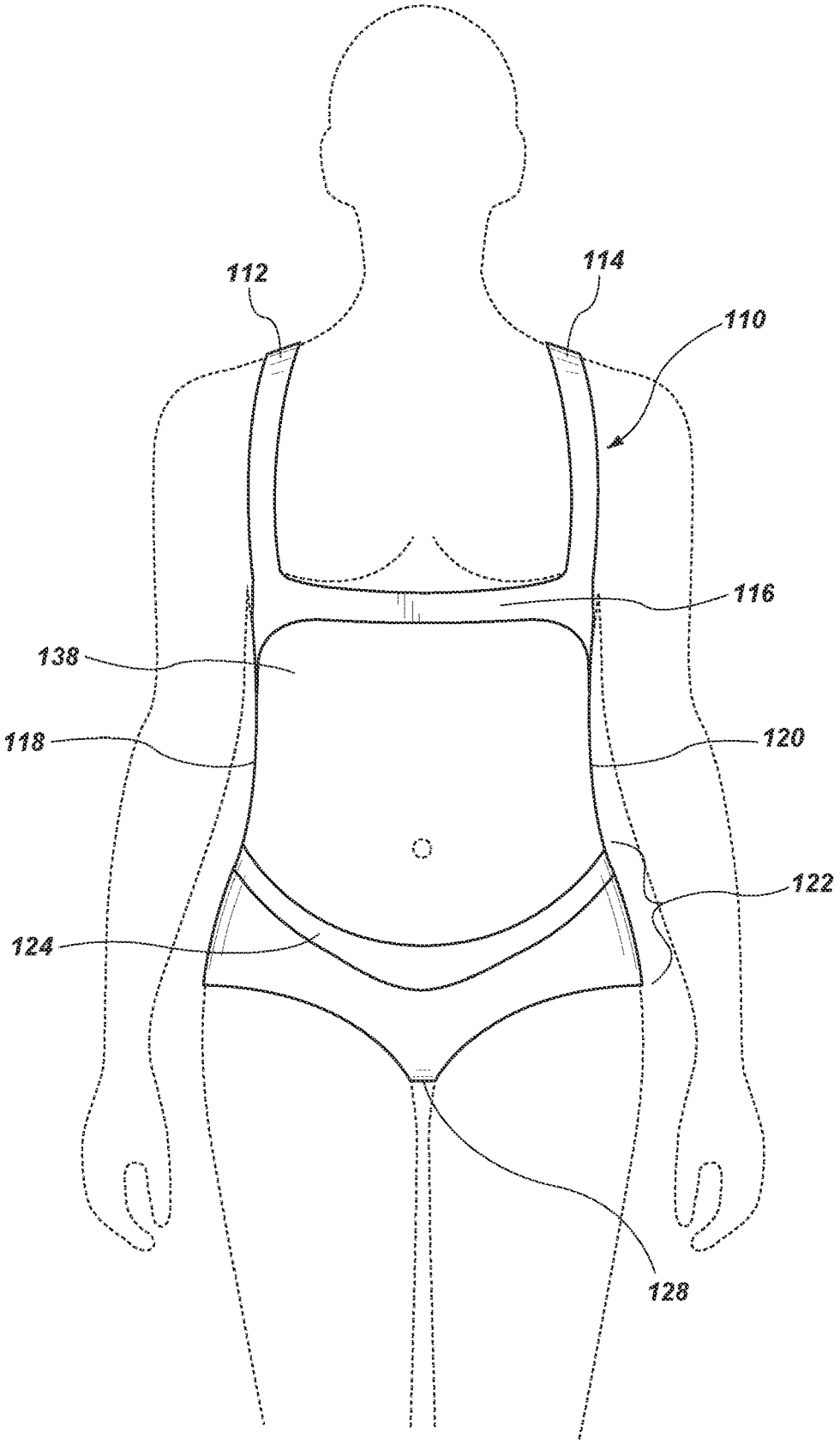
FIG. 6 is an alternate embodiment of the garment of FIG. 1 with an open belly portion.
Figure 7:
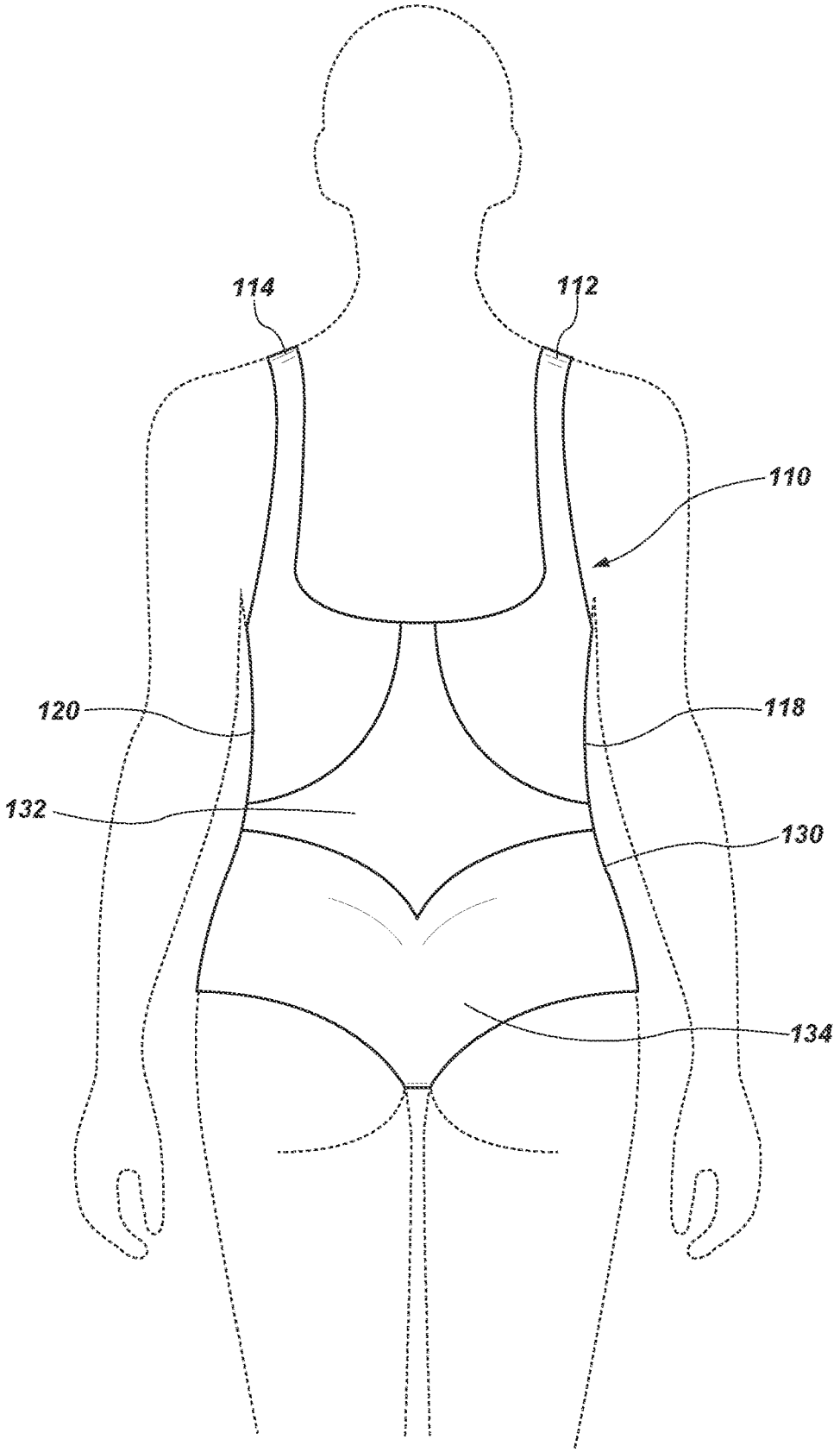
FIG. 7 is a back view of the garment of FIG. 6.
Figure 8:
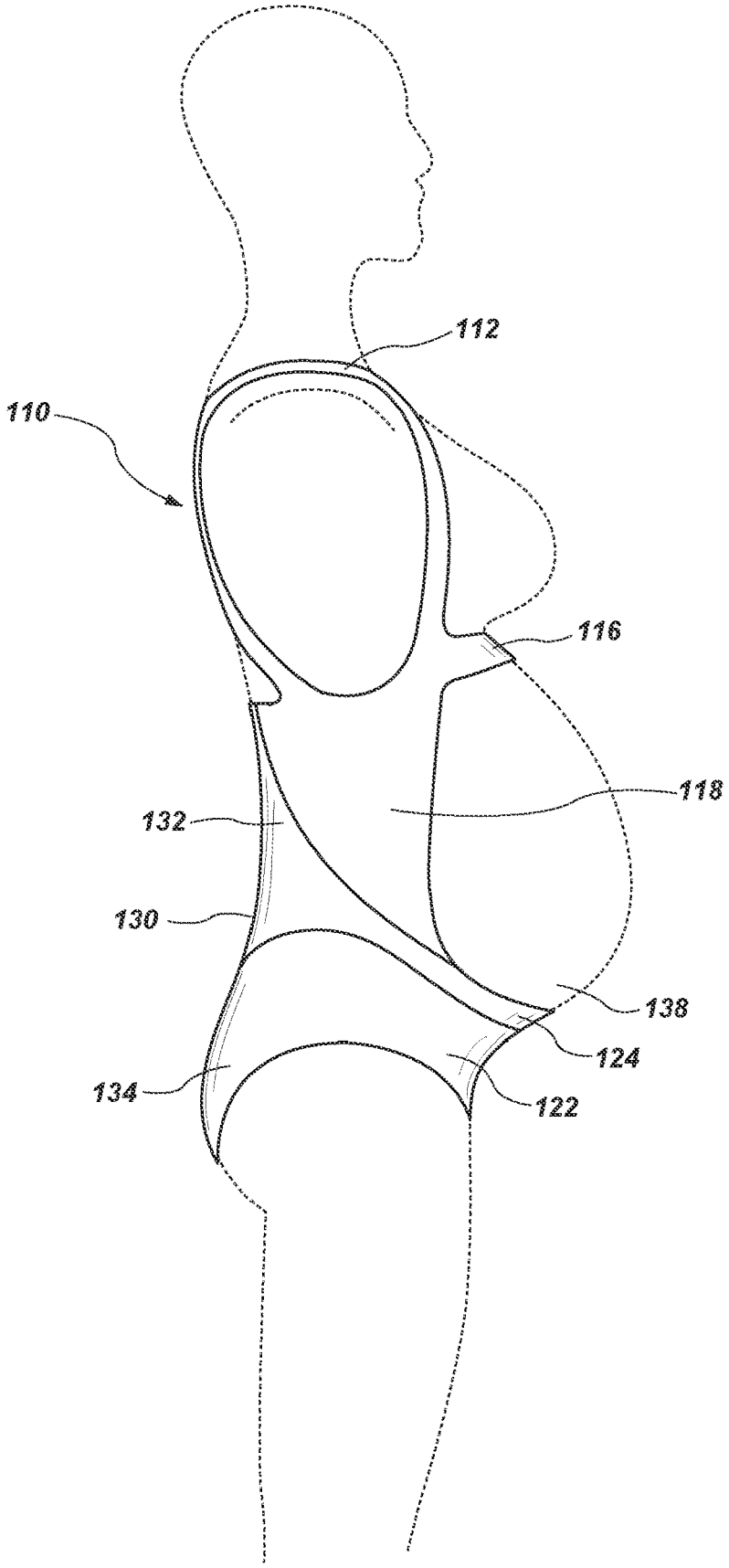
FIG. 8 is a side view of the agreement of FIG. 6.

An alternate embodiment of the garment of FIG. 1 may be depicted in FIG. 6 thru FIG. 8.

FIG. 6 illustrates a garment 110 with features that provide support for a woman who may be pregnant. The garment 110 may include a pair of shoulder straps, a first, or right, shoulder strap 112 and a second, or left, shoulder strap 14 that extend over the shoulders woman. A support band 116 may extend under the breasts of a woman while wearing the garment 110. A first, or right, side panel 118 may extend inferiorly from the right shoulder strap 112. A second, or left, side panel 120 may extend inferiorly from the left shoulder strap 114. The bust of the woman wearing the garment may be exposed allowing a woman to wear a bra of her choice.

The shoulder straps 112, 114 may extend superiorly from the right and left panels 118, 120 respectively and then extend inferiorly after passing over the shoulders of a woman. The shoulder straps 112, 114 may be comprised of a softer material any may be wider to provide a comfortable feel without the shoulder straps 112, 114 digging into the woman's shoulders. However, the shoulder straps 112, 114 may also be relatively thin. It will be appreciated that the shoulder straps 112, 114 may vary in width and may be adjustable both in length and width by a user.

A bottom portion 122, or pelvic portion, or bikini portion, may resemble women's underwear in that the pelvic portion extends from front of the woman, around the hips of the woman and passing through the groin to the buttock region. The pelvic portion 122 may include an underbelly portion 24, or lower abdomen portion, that may be reinforced fabric that may reside directly under the belly of a pregnant woman. The underbelly portion 124 may be a separate panel of fabric that is secured to the pelvic portion 122 or may be integrated to the pelvic portion 122 with additional fabric with a denser/stronger weave of material for the underbelly portion 124.

The underbelly portion 124 may extend from the side panels 118, 120. Alternatively the underbelly portion 124 may extend the entire circumference of the garment 10 extending from the anterior to the posterior, or front to the back.

The pelvic portion 122 may also include a fastening mechanism in a groin area 128 of the garment 110 that may join the front of the pelvic portion 122 to the back of the pelvic portion 122. The fastening mechanism may be a snap closure or other similar fastening mechanism commonly used in the apparel industry. The fastening mechanism may provide ease in placing the garment 110 on or removing the garment 110 as well. The fastening mechanism 126 may also provide ease for other purposes as well.

A void 138, or open portion, may be positioned on toward a front of the of the garment 110 and may extend from the support band 116 to the underbelly portion 124 and between. The void 138 may expose the belly of a pregnant woman so to provide greater comfort to the user.

Referring to FIG. 7, a posterior view of the garment 110 is illustrated. A back panel 30 may extend inferiorly from the shoulder straps 112, 114 to the pelvic portion 122. The back panel 30 may also extend from the first side panel 118 to the second side panel 120. There may not be any clear delineation from the back panel 130 and the pelvic portion 122. The back panel 130 may comprise a back support 132 which may be comprised of similar material (which may be denser), or similar weave of material, as the underbelly portion 124. The back support 132 may resemble a diamond-like pattern with one of the points of the diamond-like pattern at the perimeter of the top of the back panel 130, one point toward each of the side panels 118, 120 and finally one point toward the pelvic portion 122.

The back panel 130 may extend between the shoulder straps 112, 114 and may begin beneath the scapulae, or shoulder blades, of the woman wearing it. The shoulder straps 112, 114 and the back panel 130 may hide the straps of a bra that a woman wears. The back support 132 may reside in the lower back region of a woman while she is wearing the garment 110.

Referring to FIG. 8, as previously disclosed, the underbelly portion 124 may extend under the belly of a woman from the first and second side panels 118, 120; however, alternatively, the underbelly portion 124 may extend circumferentially and engage the back support 132 with the same material or weave of material.

The pelvic portion 122 may include a backside panel 134 that may cover the buttocks of the woman wearing the garment 110. The backside panel 134 may be a bikini cut, or brief cut, or thong cut. The bikini cut may provide more coverage of the buttocks while the thong cut may expose much of the buttocks. While it is appreciated that these two variations or cuts of the backside panel 134 may be primarily used or manufactured it will also be appreciated that a boy-short or other alternative cut may be used or manufactured as well. A woman may also choose to wear her own underwear underneath the garment 110.

Although the foregoing disclosure provides many specifics, these should not be construed as limiting the scope any of the ensuing claims. Other embodiments may be devised which do not depart from the scopes of the claims. Features from different embodiments may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

What is claimed:

1. A maternity garment comprising:

a pair of shoulder straps;

a first side panel and a second side panel comprised of a lower compression material than the pair of shoulder straps;

a void extending between the first side panel and second side panel;

a back panel joined to each of the first and second side panels and being substantially continuous with both the first and second side panels; and a pelvic portion comprising an underbelly portion, wherein the underbelly portion comprises:

a first fabric;

a second fabric secured to the first fabric and configured to provide greater compression; and at least one supportive seam crossing through the first and second fabrics, the underbelly portion being continuous with the first and second side panels.

2. The maternity garment of claim 1 comprising a first compression material and a second compression material, wherein the first compression material is of the same compression as the second compression material.

3. The maternity garment of claim 1 comprising: a first compression material and a second compression material, wherein the first compression material is of a higher compression than the second compression material.

4. The pair of shoulder straps of claim 1 comprising: a first shoulder strap and a second shoulder strap, wherein the first shoulder strap crosses a right shoulder of a user to a left side of the back panel and the second shoulder strap crosses a left shoulder to a right side of the back panel.

5. The maternity garment of claim 1 comprising: a support band extending between the first side panel and the second side panel, wherein the band extends underneath a bust, or breasts, of a user.

6. The maternity garment of claim 5, wherein the void extends between the support band and the underbelly portion.

7. The maternity garment of claim 1 comprising a plurality of fabrics secured together to form a single garment.

8. The maternity garment of claim 1, wherein the underbelly portion, the pair of shoulder straps and the back panel are comprised of higher compression material than the first side panel and second side panel.

9. The maternity garment of claim 1, wherein the pelvic portion comprises:

a pair of openings configured to fit the legs of a user; and a thong back.

10. The maternity garment of claim 1, wherein the pelvic portion comprises:

a pair of openings configured to fit the legs of a user; and a brief back.

11. A garment for pregnancy support comprising:

a front portion;

a first side panel and a second side panel;

a back panel with a higher compression than the first side panel and the second side panel, the back panel being substantially continuous with the first side panel and the second side panel;

a pair of shoulder straps extending superiorly from front portion over the shoulder of a woman and then extending inferiorly to the back panel, the pair of shoulder straps being substantially continuous with the back panel; and a bottom portion comprising:

an underbelly portion wherein the underbelly portion comprises additional fabric, the underbelly portion comprising a higher compression than the first side panel and the second side panel; and an opening extending from the first side panel to the second side panel, exposing the belly of the woman, the underbelly portion being substantially continuous with the back panel.

12. The garment of claim 11, wherein the underbelly support portion comprises a reinforced material, wherein the underbelly support portion extends from a bottom perimeter of the opening inferiorly a predetermined distance, wherein the underbelly portion is configured to reside under the belly of the woman.

13. The garment of claim 11 comprising a support band extending from the first side panel to the second side panel configured to reside under the breasts of a woman.

14. The garment of claim 11, wherein the pair of shoulder straps comprise a first shoulder strap extending over a first shoulder and a second shoulder strap extending over a second shoulder, wherein toward the back panel one of the first shoulder strap or second shoulder strap crosses over one of the first shoulder strap or second shoulder strap.

15. The garment of claim 11 comprising: a first material and a second material, wherein the first material is of a higher compression than the second material.

16. The garment of claim 11, wherein the first side panel and second side panel comprise a first material and the support band, pair of shoulder straps and back panel comprises a second material.

17. The garment of claim 11, wherein the garment comprises a one-piece seamless fabric.

18. The garment of claim 11 comprising:

a plurality of fabrics, wherein the plurality of fabrics comprise differing amounts of compression at different positions of the garment.

19. The garment of claim 18, wherein the compression of the fabric for the support band, pair of shoulder straps and back panel is the same.

20. The maternity garment of claim 18, further comprising a plurality of seams disposed where each of the plurality of fabrics join each other.

21. The maternity garment of claim 1, wherein the back panel extends from under a shoulder blade area of a user to join with the pelvic portion.

22. The maternity garment of claim 1, wherein each of the first and second side panels taper as each of the first and second side panels join the back panel.

23. The maternity garment of claim 1, further comprising a pair of support seams extending from each of the pair of shoulder straps to a bottom of the void, at least a portion of the pair of seams having a curvature corresponding to a curvature of the void.

24. The maternity garment of claim 4, wherein the first and second shoulder straps are continuous with the back panel.

* * * * *